United States Patent [19]

Fukutuka et al.

[11] Patent Number: 4,829,155

[45] Date of Patent: May 9, 1989

[54] HAIR STYLER HAVING A HEAT PIPE FORMING THE HAIR WINDING PORTION

[75] Inventors: Norifumi Fukutuka, Osaka; Masatomo Kamata, Honjyo; Toru Watanabe, Osaka; Koji Matsumoto, Amagasaki; Tomoyuki Haga; Toshimitsu Yamagishi, both of Yokohama; Hiroji Yamada, Tokyo, all of Japan

[73] Assignees: Shiseido Company Ltd.; The Furukawa Electric Co., Ltd., both of Tokyo, Japan

[21] Appl. No.: 933,670

[22] Filed: Nov. 21, 1986

[30] Foreign Application Priority Data

Dec. 12, 1985 [JP] Japan ..... 60-190358[U]

[51] Int. Cl.[4] ..... H05B 1/00; F28D 15/00; A45D 2/00; A45D 4/00

[52] U.S. Cl. ..... 219/222; 132/118; 132/233; 132/268; 165/104.21; 219/227; 219/530; 219/540

[58] Field of Search ..... 219/222–226, 219/227, 230, 530, 540; 165/104.21; 132/7, 9, 11 R, 11 A, 117, 118, 37 R, 37 A, 31 R, 32 R, 33 R, 33 G

[56] References Cited

U.S. PATENT DOCUMENTS

| | | | |
|---|---|---|---|
| 57,354 | 8/1866 | Maxim | 219/227 X |
| 2,835,480 | 5/1958 | Perez | 165/104.21 |
| 2,918,561 | 12/1959 | Perez | 165/104.21 |
| 3,379,118 | 4/1968 | Perez | 165/104.21 |
| 3,660,634 | 5/1972 | Scott | 219/222 |
| 3,889,096 | 6/1975 | Asselman et al. | 219/236 X |
| 4,486,915 | 12/1984 | Stewart et al. | 219/222 X |

FOREIGN PATENT DOCUMENTS

| | | | |
|---|---|---|---|
| 43907 | 1/1982 | European Pat. Off. | 219/225 |
| 54-94959 | 7/1979 | Japan . | |
| 60-40161 | 12/1985 | Japan . | |
| 630045 | 9/1978 | U.S.S.R. | 219/230 |
| 946834 | 8/1982 | U.S.S.R. | 219/230 |

*Primary Examiner*—Anthony Bartis

*Attorney, Agent, or Firm*—Sprung Horn Kramer & Woods

[57] ABSTRACT

A hair styler for winding hair thereon for curling, comprising a hollow sealed tubular member made of a metallic material having good thermal conductivity and defining a heat pipe having a heat dissipating hair winding portion. The tubular member contains a charge of a working fluid vaporizable at an operating temperature of 50° C. to 70° C. The outer surface of the heat dissipating portion of the heat pipe is covered with an elastic hair engagement member for preventing hair slippage. The heat receiving end portion of the heat pipe is exposed so as to be adapted to receive heat from a separate external heat source having a temperature range of 50° C. to 120° C. Thereby hair wound around the outer surface of the heat dissipating portion of the heat pipe forming the bobbin is heated by the condensation of the vaporized working fluid within the heat pipe.

2 Claims, 4 Drawing Sheets

HAIR STYLER HAVING A HEAT PIPE FORMING THE HAIR WINDING PORTION

BACKGROUND OF THE INVENTION

1. Field of the Invention

The present invention relates to a hair styler for shaping hair (including eyelashes, etc.), more particularly to a heater-type hair styler in which hair is held in a desired form by brushes, combs, or other styling means and heat applied to fix the hair in that style. The present invention typically relates to hair curlers used when curling hair.

2. Description of the Related Art

Known conventional heater type hair stylers use combs, brushers, irons, and other styling devices to style hair, eyelashes, and other body hair to a desired form, and use heat to fix the hair in that form. As the heating means, generally the styling device itself is heated or hot air is blown on the hair while held by the styling device. In hair stylers where the styling device itself is heated, a heat source is built into the handle portion holding the styling device and heat conduction used to heat the device, or a heat source is built into the styling device itself for internal heating. In both constructions, however, it is difficult to obtain a uniform heat distribution over the styling device as a whole, and local high temperature portions are formed, which can cause damage to the hair, etc.

In the hot air method, a hot air generator is built into the handle portion holding the styling device and hot air blown out toward the device, or a separate dryer is used. In this method too, however, it is difficult to ensure a uniform flow of hot air on the hair, etc., wound around the styling, and to possible overheating and damage of portions of the hair.

In conventional hair curlers, a cylindrically shaped bobbin is pre-heated by an electric or other heating means to a predetermined temperature, the portion of the hair desired to be curled is wound around the heated bobbin and fixed in place with a clip, etc., and the hair held in that wound position for a set time; thus heating the wound hair from the inside with heat from the bobbin, and forming a curl therein. For the means of heating the bobbin, electrical and other heat sources have been used to heat a heating plate to which a plurality of heating rods, over which bobbins are fitted, are attached separately. Namely, the bobbins are inserted over the heating rods and the heat from the heat source is conducted to the bobbins via the heating plate and heating rods. If the heat conductivity of the heating plate and heating rods is low, however, there is a long wait until the bobbins are heated to the usage temperature. Further, the temperature of the heating plate and heating rods is high at portions close to the heat source and lower at portions away therefrom, and accordingly, the temperature of the individual bobbins differs depending on the position of the heating rods over which the bobbins are inserted; also there are temperature differences among the individual heating rods. As a result, the temperature of the heated bobbins is not uniform and, therefore, the hair wound around the bobbins cannot be curled uniformly or, depending on the time wound, the temperature may become too high and cause damage to the hair. For this reason, in the prior art, a hair curler has been proposed in which rod-shaped heat pipes having a superior heat conductivity are used as the medium for conducting heat from the heat source to the bobbins, with bobbins inserted over the rod shaped heat pipes for uniform heating (see Japanese Unexamined Patent Publication (Kokai) No. 54-94959). The heat pipe are used because they have a high heat conductivity, and thus heat from the heat source is quickly conducted through the heat pipes to the bobbins and the bobbins are heated in a short time. Further, a heat pipe has a uniform internal temperature, and thus the temperature thereof remains substantially the same even at a distance from the heat source, and hence the bobbins can be uniformly heated.

Nevertheless, in the prior art, when winding hair around a plurality of bobbins, a considerable time elapses from when winding hair around the first bobbin to when winding hair around the last bobbin. On the other hand, bobbin removal from the hair is easily made by simply extracting a clip, and thus can be performed in an extremely short time compared with the winding time. As a result, the heating time for the hair wound on a first bobbin is longer than the heating time for the hair wound on the last bobbin, and accordingly, the degree of curl imparted is greater for the first bobbin, and is correspondingly less for each successive bobbin, adn thus a problem arises in that the curling effect differs with each bobbin. Further, when winding heat on a bobbin, there are easy and difficult winding locations depending on whether the hair is at the front, back, etc., of the head, so that the time required for winding further differs. Moreover, the bobbins also discharge heat during this winding work, and therefore, the temperature of the bobbins when the winding is completed is low when the winding has taken a long time and is high when the winding has been completed in a short time. Therefore, the problem again arises of the occurrence of a different hair curling effect depending on the individual bobbins.

Stylers are known in which heating elements are placed in the bobbins to generate heat therein, but although the bobbins are uniformly heated, the same problem arises as in the prior art in the winding of the hair after the bobbins have been preheated. In addition, the heating elements can be used only once, so the problem of higher costs arises.

SUMMARY OF THE INVENTION

Accordingly, an object of the present invention is to provide a heater type hair styler in which the problems of the prior art heater type hair stylers can be overcome and hair curled by uniform heating without causing damage to the hair.

Another object of the present invention is to provide a hair curler in which, when curling hair using a plurality of bobbins, the bobbins are heated to a prdetermined temperature after the hair is wound thereon so that, regardless of the difference in time from the winding to unwinding of individual bobbins, deriving from the order in which the hair is wound on the bobbins, the time for which the hair is heated by the bobbins can be made constant and, further, so that, regardless of the difference in time required for winding the hair on the individual bobbins, the initial temperature of the heating of the hair by the individual bobbins can be made constant, whereby the curling effect on the hair wound on the individual bobbins can be made uniform and the desired styling achieved.

A further object of the present invention is to provide a hair curler in which hair is brought into direct contact with heat pipes to increase the hair curling effect and slippage during hair winding is prevented so as to increase the hair winding efficiency, whereby the desired hair style is obtained.

Other objects and advantages of the present invention will be apparent from the following description.

In accordance with one aspect of the present invention, there is provided a hair curler in which an internally sealed bobbin comprising the hair curler is constituted of a heat pipe.

In accordance with a further aspect of the present invention, there is provided a hair curler for curling hair wound thereon constituted by a bobbin comprising a heat pipe around which, at appropriate intervals an elastic engagement member is provided for preventing hair slippage and subsequent exposure of the bobbin surface to the air.

More specifically, there is provided a hair styler for winding hair thereon for curling, comprising a hollow sealed tubular member made of a metallic material having good thermal conductivity and defining a heat pipe having a heat dissipating hair winding portion. The tubular member contains a charge of a working fluid vaporizable at an operating temperature of 50° C. to 70° C. The outer surface of the heat dissipating portion of the heat pipe is covered with an elastic hair engagement member for preventing hair slippage. The heat receiving end portion of the heat pipe is exposed so as to be adapted to receive heat from a separate external heat source having a temperature range of 50° C. to 120° C. Thereby hair wound around the outer surface of the heat dissipating portion of the heat pipe forming the bobbin is heated by the condensation of the vaporized working fluid within the heat pipe.

BRIEF DESCRIPTION OF THE DRAWINGS

The present invention will be better understood from the description set forth below with reference to the accompanying drawings, in which.

DESCRIPTION OF THE PREFERRED EMBODIMENTS

A description will now be given of a first aspect of the present invention, with reference to the drawings.

Figure 1:
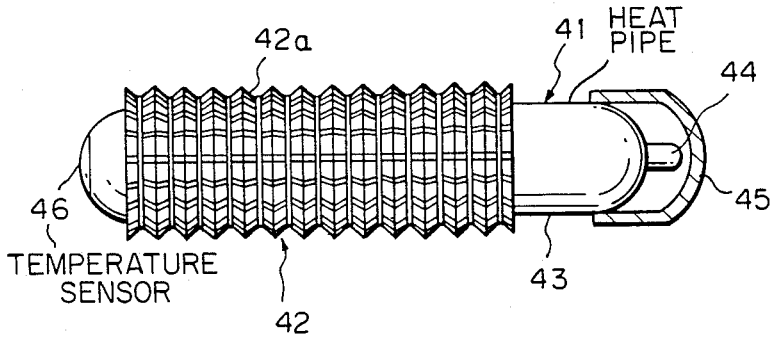
FIG. 1 is a partially cut away cross-sectional view of a bobbin of a hair curler according to a first aspect of the present invention.

FIG. 1 shows a hair curler according to the first aspect of the present invention, in which reference numeral 41 denotes a bobbin constituted by a heat pipe. The heat pipe is provided with a cylindrically shaped cover 42 for winding the hair. The cover 42, in this embodiment, is formed by silicone rubber, which has a superior heat resistance and elasticity, but the material of the cover 42 is not limited to silicone rubber and may be any material having heat resistance and elasticity. Further, the outer surface of the cover 42 is formed with grooves **42*a* running around the entire circumference thereof, to facilitate winding of the hair. As shown in FIG. 1, plurality of these grooves 42*a* are provided in the longitudinal direction of the cover 42**.

The cover 42 is shorter in overall length than the heat pipe, and thus one end of the heat pipe protrudes from the cover 42 to form the heat receiving portion 43 to be heated by a dryer or other heating means. The heat receiving portion 43 has a projection 44 formed at one end thereof which is used to close a hole after a vacuum treatment has been carried out during the forming process of the heat pipe. The projection 44 is protected by a protective cover 45. In this embodiment, the projection 44 is provided at the side where the heat receiving portion 43 of the heat pipe is located. Note, either or both ends of the heat pipe can be used as the heat receiving portion(s), or heating may be additionally performed from outside of the cover 42.

When only one end of the heat pipe is used as the heat receiving portion 43, the heat pipe is provided, at the end opposite to the projection 44, with a temperature display portion 46 constituted by a thermochromic material which changes color in accordance with changes in temperature, and thus enables a visual judgment of whether a predetermined temperature has been reached by the bobbin 41.

Figure 2:
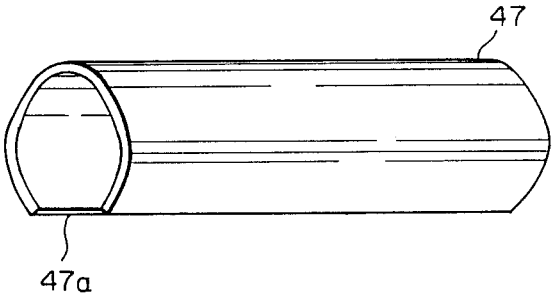
FIG. 2 is a perspective view of a heat clip which is attached to the bobbin of FIG. 1.

FIG. 2 shows a heat retaining cover 47. After the hair is wound on the bobbin 41, this heat retaining cover 47 is attached to the bobbin 41 over the hair, to hold the hair in place and retain the heat. The heat retaining cover 47 is a flexible cylindrical member having an outer diameter smaller than the bobbin 41, and is formed with a slit **47*a* extending over the entire longitudinal direction thereof so that the cover 47 may be pulled apart and fitted over the bobbin 41**.

An explanation will now be made of the operation of the above embodiment. First, the portion of the hair to be curled is wound around the bobbin 41 by the usual bobbin winding procedure. Namely, the hair is wound around the cover 42, leaving the heat receiving portion 43 exposed. Next, the heat retaining cover 47 is fitted over the wound hair to fix the hair in the wound state on the bobbin 41. A hair dryer is then used to heat the heat receiving portion 43 to a suitable temperature (50° C. to 70° C.). Due to the high heat conductivity thereof, the heat pipe is heated to the desired temperature in a short time, and further, the temperature inside the heated heat pipe is uniform. Therefore, the hair wound on the bobbin 41 is uniformly heated. At the same time, hot air from the hair dryer heats the heat retaining cover 47, so that the hair wound on the bobbin 41 is also heated from the outside via the heat retaining cover 47, and thus the time required for the bobbin 41 to reach the desired temperature can be further shortened.

When the bobbin 41 reaches the predetermined temperature, the temperature display portion 46 displays a predetermined color. At that point, the heating is stopped and the bobbin 41 left for about 3 to 20 minutes before removal. During that interval, the hair wound on the bobbin 41 is heated by the bobbin 41 and the heat is retained in the hair by the heat retaining cover 47, with the result that an efficient heating is carried out and the desired curling is effected in a short period of time.

Note that the temperature range of the hair dryer may be from 50° to 120° C., including variations due to distance of the hair dryer from the heat receiving portion 43 of the bobbin 41. Within that range, any temperature hot air can be used as heat source.

Further, although in this embodiment water is used as the working fluid in the heat pipe, freon, methanol, ethanol, etc., also may be used. Further, in this embodiment, the sealed hollow body constituting the heat pipe is made of tin-plated copper, but any material compatible with the working fluid may be selected when forming the heat pipe. If the working fluid is water, in addition to copper, Monel metal may be used. If the working fluid is Freon, copper and aluminum may be used, and if methanol is used, copper, stainless steel, silica, etc., may be selected. In all cases, a material having a good compatibility with the working fluid should be chosen.

In the first aspect of the present invention, having the constitution and mode of operation as described above, by constituting the bobbin by a heat pipe having an extremely high heat conductivity, the bobbin can be heated to a predetermined temperature by a hair dryer or other heating means in an extremely short time. Therefore, even when a number of bobbins are used for curling the hair, it is possible to heat all of the bobbins to the desired temperature in a short time by first winding the hair on and then heating the bobbins. The time for which the hair wound on the individual bobbin is heated by the bobbins, i.e, the time until the bobbins are removed, becomes roughly the same for all of the bobbins, so the curling effect on the hair wound on the bobbins becomes uniform. Further, the heat pipe has a uniform temperature even if only part of the pipe is heated, so a uniform curl is given to the hair wound on each individual bobbin. Further, since the hair wound on the bobbins is heated to the predetermined temperature after winding, there is no variation in the temperature at the start of heating of the hair, as in the past, due to the difference in time required for winding.

Further, since heating is performed after the heat is wound, when a heating means is used to heat the bobbins, both the bobbins and the hair wound thereon are heated from both the inside and the outside, i.e., the hair is heated from inside by the bobbins and from outside by the heating means, thus enabling the desired curling effect to be achieved in a shorter time than with conventional hair curlers.

Further, the bobbins can be used repeatedly, and since they are metallic, the bobbins are durable and can be used for a long time. Therefore, the bobbins according to the present invention are lower in cost than the conventional bobbins having internal heating elements.

Next, an explanation will be given of a second aspect of the present invention, with reference to the drawings.

Figure 3:
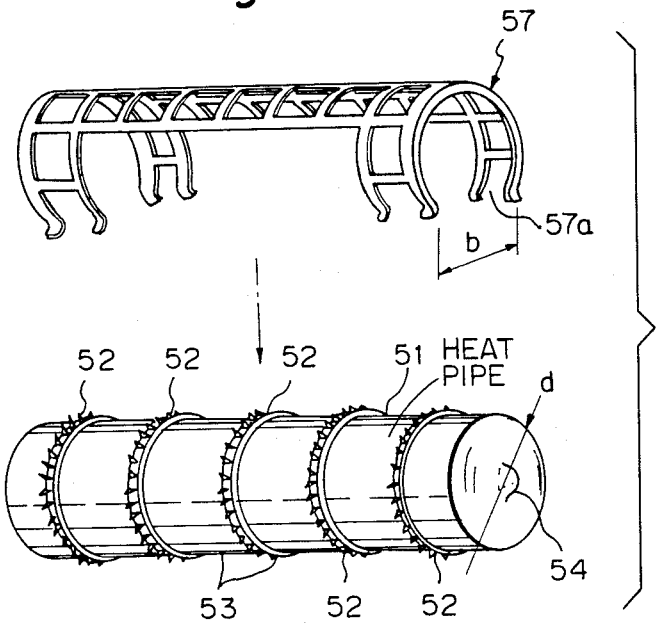
FIG. 3 is a perspective view of a hair curler according to a second aspect of the present invention.

In the hair curler shown in FIG. 3, reference numeral 51 denotes a bobbin constituted by a cylindrically shaped sealed hollow body, i.e., a heat pipe. It is water or another working fluid is sealed therein under a reduced pressure. The bobbin 51 has a plurality (five in the illustration) of ring-shaped elastic engagement members 52 attached on the outside thereof, at predetermined pitches along the longitudinal direction thereof to leave portions of the surface of the bobbin 51 exposed to the outside. These elastic engagement members 52 are formed of silicone rubber or other materials having a superior heat resistance and elasticity and on the outer surfaces thereof, as shown in detail in FIG. 4 and FIG. 5, a plurality of mountain shaped projections 52*a* are formed at an equal pitch.

The exposed portion of the bobbin 51 not covered by the elastic engagement members 52 constitutes a heat receiving portion 53, which is heated by a hair dryer or other heating means. Further, the bobbin 51 has a projection 54 formed at one end thereof for closing off a hole after a vacuum treatment has been carried out during the forming process of the heat pipe. Although not shown, the bobbin 51 may have at the other end thereof a temperature display portion enabling the state of heating of the bobbin 51 to be judged by a color change thereof.

In FIG. 3, reference numeral 57 denotes a cover, and after the hair is wound on the bobbin 51, the cover is fitted over the bobbin 51, and over the wound hair, to hold the wound hair on the bobbin 51. The cover 57 is integrally formed of a plastic and is roughly cylindrical and meshlike in shape and has an attachment opening 57*a* along the entire longitudinal direction thereof. The width b of the attachment opening 57*a* is smaller than the outer diameter of the bobbin 51, and for attachment, the attachment portion 57*a* of the cover 57 is spread further open and fitted over the bobbin 51.

The mode of operation of the hair curler of the second aspect of the present invention will now be explained.

First, the portion of hair to be curled is wound around the bobbin 51 by the usual procedure for winding hair on bobbins. At this time, as a plurality of elastic engagement members 52 each having a plurality of projections 52*a* are provided along the longitudinal direction of the bobbin 51, the projections 52*a* of the elastic engagement members 52 catch the hair without slippage when the bobbin 51 is turned to wind the hair thereon, and as a result, the operation of winding the hair on the bobbin 51 can be performed easily and efficiently.

The cover 57 is attached over the hair wound on the bobbin 51 to fix the hair in the wound state on the bobbin 51. A hair dryer is then used to heat the heat receiving portion 53 of the bobbin 51 to a suitable temperature (50° C. to 70° C.), whereupon the heat applied to the heat receiving portion 53 evaporates the water or other working fluid sealed in the heat pipe and causes the heat to move as latent heat of the evaporation. This latent heat is directly transmitted to the hair via the surface of the bobbin 51, thus uniformly heating the hair and greatly improving the curling effect.

When the bobbin 51 is heated to the predetermined temperature, the heating is stopped and the bobbin 51 allowed to stand for about 3 to 20 minutes before removal from the hair. As mentioned earlier, the hair is efficiently wound on the bobbin 51 due to the action of the elastic engagement members 52 provided on the outside of the bobbin 51, thus enabling the desired hair style to be easily obtained.

Figure 6A:
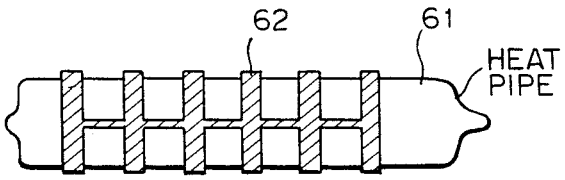
FIGS. 6(A) to 6(D) are side views of hair curlers according to a second aspect of the present invention.
Figure 6B:
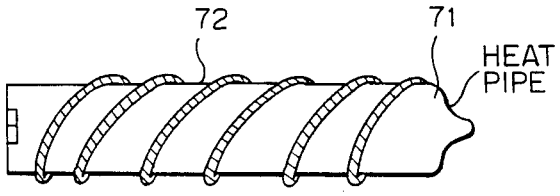
Figure 6C:
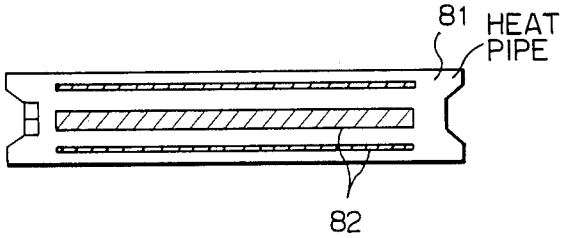
Figure 6D:
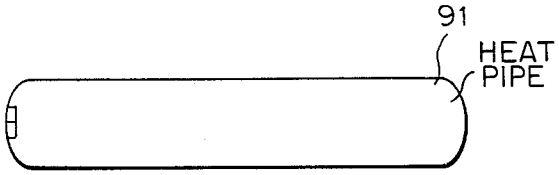

In the above embodiment, use was made of ring shaped elastic engagement members 52, but other members as shown in FIGS. 6(A), (B), and (C) also may be used. FIG. 6(A) shows an elastic engagement member 62 constituted by ring-shaped members integrally joined together, FIG. 6(B) shows an elastic engagement member 72 wound in a spiral fashion around the outside of a bobbin 71, and FIG. 6(C) shows elastic engagement members 82 arranged longitudinally on the outside of a bobbin 81 along the longitudinal direction thereof. Further, the bobbin may be shaped as shown in FIGS. 6(A), (B), (C), and (D). That is, the bobbins 61, 71, 81, and 91 shown in FIGS. 6(A), (B), (C), and (D) are, respectively, a standard type, flat bottom type, valley shaped left-right symmetrical type, and mountain shaped left-right symmetrical type.

Figure 4:
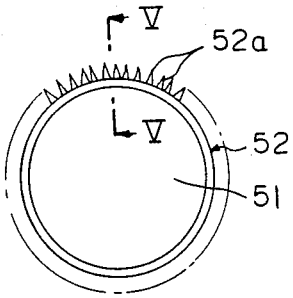
FIG. 4 is a front view of an elastic engagement member according to the second aspect of the present invention.
Figure 5:
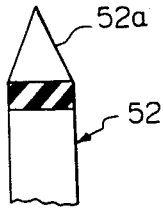
FIG. 5 is an enlarged cross-sectional view taken along line V—V of FIG. 4.
Figure 7A:
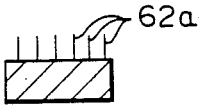
FIGS. 7(A) to 7(E) are views of embodiments of the engagement means of the elastic engagement member.
Figure 7B:
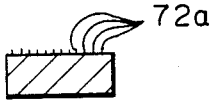
Figure 7C:
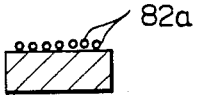
Figure 7D:
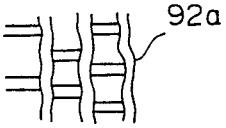
Figure 7E:
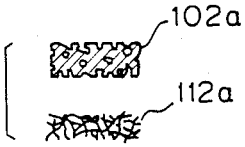

As the means for providing the elastic engagement members with the ability to prevent hair slippage, the means shown in FIGS. 7(A) to (E) may be provided in addition to the mountain shaped projections 52*a* shown in FIG. 4 and FIG. 5. Namely, FIG. 7(A) shows of a plurality of projections 62*a* provided on the outer surface of an elastic engagement member along the circumferential and widthwise directions, FIG. 7(B) shows the provision of finer projections 72*a* in greater numbers, FIG. 7(C) shows the adhesion of a plurality of granular particles 82*a* to the outer surface of the elastic engagement member, FIG. 7(D) shows the processing of the outer surface of the elastic engagement member to form a mesh 92*a*, and FIG. 7(E) shows a surface treatment of the elastic engagement member to obtain a foamed state 102*a* or a metallic mesh state 112*a* thereof.

The elastic engagement members 62, 72, and 82, shown in FIGS. 6(A) to (C), and the engagement means 62*a*, 72*a*, 82*a*, 92*a*, 102*a*, and 112*a* applied to their surfaces, shown in FIGS. 7(A) to (E), may be combined in any manner.

As clear from the above explanation, according to the third aspect of the present invention, the hair is brought into direct contact with the heat pipe, to receive an extremely high heat conductivity from the heat pipe and to greatly improve the curling effect on the hair. Further, as elastic engagement members are provided on the surface of the bobbin constituting the hair curler, to prevent hair slippage, the operation of winding the hair on the bobbin can be performed easily, efficiently, and perfectly, thus enabling the desired hair style to be obtained without trouble.

We claim:

1. A hair styler for winding hair thereon for curling, comprising a hollow sealed tubular member made of a metallic material hving good thermal conductivity and defining a heat pipe having a heat dissipating hair winding portion and containing a charge of a working fluid vaporizable at an operating temperature of 50° C. to 70° C., the outer surface of the heat pipe being covered with an elastic hair engagement member for preventing hair slippage, and covering the outer surface of the heat dissipating portion of the heat pipe while leaving the heat receiving end portion exposed so as to be adapted to receive heat from a separate external heat source having a temperature range of 50° C. to 120° C. whereby heat wound around the outer surface of the heat dissipating portion of the heat pipe forming the bobbin is heated by the condensation of the vaporized working fluid within the heat pipe.

2. A hair styler according to claim 1, wherein the elastic hair engagement member is provided over the outer surface of the heat pipe in such a manner that hair wound on the heat pipe is partly directly brought into contact with the outer surface of the heat dissipation portion of said heat pipe.

* * * * *

UNITED STATES PATENT AND TRADEMARK OFFICE

CERTIFICATE OF CORRECTION

PATENT NO. : 4,829,155

DATED : May 9, 1989

INVENTOR(S) : Fukutuka et al

It is certified that error appears in the above-identified patent and that said Letters Patent is hereby corrected as shown below:

| | |
|---|---|
| Col. 8, line 9 | Delete "hving" and substitute--having-- |
| Col. 8, line 20 | Delete "heat" and substitute --hair-- |

Signed and Sealed this

Twenty-sixth Day of June, 1990

*Attest:*

HARRY F. MANBECK, JR.

*Attesting Officer*

*Commissioner of Patents and Trademarks*